US006177395B1

(12) United States Patent
Silvaggi et al.

(10) Patent No.: US 6,177,395 B1
(45) Date of Patent: Jan. 23, 2001

(54) CARPET CLEANING COMPOSITIONS AND METHOD FOR CLEANING CARPETS

(75) Inventors: Lorena Silvaggi, Passoscuro/Rome; Floriana Raso, Rome, both of (IT)

(73) Assignee: The Procter & Gamble Company, Cincinnati, OH (US)

( * ) Notice: Under 35 U.S.C. 154(b), the term of this patent shall be extended for 0 days.

(21) Appl. No.: 09/297,432

(22) PCT Filed: Oct. 30, 1997

(86) PCT No.: PCT/US97/19792

§ 371 Date: Apr. 30, 1999

§ 102(e) Date: Apr. 30, 1999

(87) PCT Pub. No.: WO98/18894

PCT Pub. Date: May 7, 1998

(30) Foreign Application Priority Data

Oct. 31, 1996 (EP) ..... 96870136

(51) Int. Cl.[7] ..... C11D 7/38

(52) U.S. Cl. ..... 510/278; 510/280; 510/309; 510/371; 510/372; 510/505; 510/506

(58) Field of Search ..... 510/278, 280, 510/314, 302, 372, 374, 371, 375, 309, 505, 506

(56) References Cited

U.S. PATENT DOCUMENTS

| | | | |
|---|---|---|---|
| 5,250,212 | 10/1993 | de Buzzaccarini et al. | 252/104 |
| 5,622,646 | 4/1997 | Scialla et al. | 252/186.33 |
| 5,905,065 | 5/1999 | Scialla et al. | 510/280 |

FOREIGN PATENT DOCUMENTS

96870022 * 10/1996 (EP) .

* cited by examiner

*Primary Examiner*—Necholus Ogden
(74) *Attorney, Agent, or Firm*—Jason J. Camp

(57) ABSTRACT

Compositions particularly suitable for the cleaning of carpets comprise: a peroxygen bleach; an alcohol having the formula R—OH wherein R is linear or branched, saturated or unsaturated hydrocarbon chain of 1 to 4 carbon atoms and a second solvent selected from the group consisting of a hydrophilic solvent comprising one or more ether groups and having a solubility in water higher than 10 ml per 100 ml at 25° C.; a polyol hydrophilic solvent having a solubility in water higher than 10 ml per 100 ml at 25° C.; a hydrophobic solvent having a solubility in water lower than 10 ml per 100 ml at 25° C.; and mixtures thereof; at a weight ratio of said alcohol to said second solvent of 1:10 to 1:1.1. The compositions are particularly suitable for the cleaning of carpets, resulting in improved overall stain removal performance, especially on particulate stains, greasy/oily stains, bleachable stains, and/or enzymatic stains.

27 Claims, No Drawings

CARPET CLEANING COMPOSITIONS AND METHOD FOR CLEANING CARPETS

TECHNICAL FIELD

The present invention relates to cleaning compositions and more particularly to cleaning compositions having the ability to remove various types of stains/soils from carpets.

BACKGROUND OF THE INVENTION

Carpets produced from synthetic or natural fibers and mixtures thereof are commonly used in residential and commercial applications as a floor covering. Various types of fibers can be used in making carpets such as polyamide fibers, polyester fibers as well as wool, cotton or even silk in the case of rugs.

However, carpets irrespective of whether they are made from natural or synthetic fibers are all prone to soiling and staining when contacted with many household items. Foods, grease, oils, beverages in particular such as coffee, tea and soft drinks especially those containing acidic dyes can cause unsightly, often dark stains on carpets. Also fibers may become soiled as a result of dirt particles, clay, dust, i.e., particulate soils in general, coming into contact with and adhering to the fibers of the carpet. These latter soils often appear in the form of a diffuse layer of soils rather than in the form of spots and tend to accumulate particularly in the so called "high traffic areas" such as near doors as a result of intensive use of the carpets in such areas.

There are a number of carpet cleaning compositions described in the art for removing stains and soils. However, these compositions do not satisfactorily meet the consumer's needs regarding their stain removal performance on different types of stains and soils. Indeed, these carpet cleaner compositions are not fully satisfactory on removing bleachable stains, enzymatic stains as well as particulate stains and/or greasy stains;, especially in the so called "high traffic areas".

Thus the object of the present invention is to provide compositions suitable for cleaning carpets that deliver overall improved stains removal performance on various types of stains including particulate stains, greasy stains, bleachable stains and/or enzymatic stains.

It has now been found that the above object can be met by formulating compositions which comprises a peroxygen bleach, an alcohol having the formula R—OH wherein R is a linear or branched, saturated or unsaturated hydrocarbon chain of 1 to 4 carbon atoms, as a first solvent, and a second solvent selected from the group consisting of a hydrophilic solvent comprising one or more ether groups and having a solubility in water higher than 10 ml per 100 ml at 25° C., a polyol hydrophilic solvent having a solubility in water higher than 10 ml per 100 ml at 25° C., a hydrophobic solvent having a solubility in water lower than 10 ml per 100 ml at 25° C. and mixtures thereof, at a weight ratio of said alcohol to said second solvent of 1:10 to 1:1.1. Indeed, such a composition provides improved overall stain removal performance on various stains including greasy stains, bleachable stains, enzymatic stains and/or particulate stains, especially on diffuse layers of stains/soils which occur in the so called "high traffic areas", i.e., on stains/soils which have become otherwise extremely difficult to remove. More particularly, it has been found that the combination of a C1–C4 alcohol with a second solvent, as defined herein, results in a synergistic effect on the removal of greasy stains, particulate stains, enzymatic stains, and/or bleachable stains from carpets.

An advantage of the present invention is that it is applicable to a variety of carpet cleaning compositions, i.e., compositions being either in a liquid form or in a powder form or in a granular form.

Furthermore, it has surprisingly been found that the liquid compositions herein comprising a peroxygen bleach, a C1–C4 alcohol and a second solvent, as defined herein, exhibit improved chemical stability, as compared to the same liquid compositions without such a solvent system at the appropriate ratios as described herein, or comprising only said C1–C4 alcohol or only said second solvent.

Another advantage of the liquid compositions of the present invention, or the granular or powder compositions herein that have been diluted typically with water so as to be applied onto a carpet in a liquid form, is that an excellent foam profile is achieved. Indeed, it has surprisingly been found that the foam persistence is reduced with the compositions of the present invention as compared to the same compositions without said solvent system at the appropriate ratios as described herein, or comprising only said C1–C4 alcohol or only said second solvent. This reduced foam persistence contributes to the improved particulate stain removal performance of the compositions of the present invention. Indeed, it is believed that when a composition according to the present invention in its liquid form, is applied onto a carpet, the foam produced incorporates the particulate soils and bring them to the surface of the carpet as the foam dissolves, facilitating thereby the removal of the particulate soils. Another advantage of the present invention is that the compositions herein may be easily and quickly diluted in water without the need that said compositions comprise a defoamer. In other words, the present invention allows to formulate compositions with improved overall stain removal performance and desirable foam characteristics, when used in a liquid form, at reduced costs, i.e. without adding any defoamer that would raise the cost formula without: contributing to the stain removal performance of said compositions.

A further advantage of the present invention is that the compositions herein are applicable to all carpet types, especially delicate natural fibers, and are also safe to all carpet dye types, particularly sensitive natural dyes used therein. The compositions of the present invention are also suitable to be used to clean upholstery and car seats covering. Furthermore, the compositions herein may also be used in laundry applications as a laundry detergent or additive or even in a laundry pretreatment application as well as in hard surfaces applications to clean for example tiles, floors, grouting, sinks, fibergrass, plastics and the like.

Yet another advantage of the compositions of the present invention is that they may be applied directly on the carpet without causing damage to the carpet. In addition the cleaning action of the invention commences as soon as the carpet cleaning composition has been applied to the surface. Indeed, the use of a carpet cleaning composition of the present invention does not necessarily require rubbing and/or brushing of the carpet.

BACKGROUND ART

The following documents are representative of the prior art available on carpet cleaning compositions.

EP-A-629 694 discloses the use of stable aqueous compositions comprising a source of active oxygen, having a pH of from 1 to 6, for the cleaning of carpets. No solvent system with an alcohol having the formula R—OH wherein R is a linear or branched, saturated or unsaturated hydrocarbon chain of 1 to 4 carbon atoms, as a first solvent, and a second solvent, as defined herein, at a weight ratio of said C1–C4 alcohol to said second solvent of 1:10 to 1:1.1, is disclosed.

European patent application number 96870022.9 discloses a carpet cleaning composition comprising salicylic acid, and a compound selected from the group consisting of amine oxides, soil suspending polycarboxylate or polyamine polymers, hydroxy-pyridine N-oxides, chelating agents and mixtures thereof. Solvents like octyl alcohol, isopropanol alcohol, propyl alcohol, ethoxy propoxy alcohol, buthoxypropoxy alcohol and/or furfuryl alcohol are mentioned therein. However, no particular weight ratios are disclosed for C1–C4 alcohol to a second solvent as defined in the present invention.

FR 2240 287 discloses a powder for the cleaning of carpet comprising a solvent like alcohols, glycols, hydrocarbures and a surfactant. Isopropyl alcohol is mentioned amongst the preferred solvents. Also mixtures of solvents are exemplified like ethyleneglycol and isopropanol alcohol. No peroxygen bleaches are disclosed.

U.S. Pat. No. 4,490,270 discloses aqueous solution compositions for the use in cleaning and sanitising carpets consisting of surfactants like sodium lauryl sulfate, a fatty acid alkylamide sulfosuccinate and/or lauryl ether sulfate, monopotassium phosphate, glutaraldehyde, and solvents like about 3% of isopropanol, about 2% of propylene glycol, methyl ether or butoxy ethanol, and about 0.25% of amyl acetate. No peroxygen bleaches are disclosed.

WO 89/12673 discloses acaricidal detergent compositions for cleaning carpet comprising a mixtures of surfactants, alcohol (0.05%–25%) such as benzyl alcohol, a glycol or alkyl glycol solvent. Hydrotropes are added as optional ingredients (1%–25%) like isopropanol. No peroxygen bleaches are disclosed.

GB 2167 083 discloses hard surface cleaning compositions comprising 1%–10% of a low boiling solvent (e.g. isopropanol), 1%–10% of benzyl alcohol, a surfactant, an alkaline material and water. Good greasy soil removal is achieved while leaving only an insubstantial amount of film on the surface cleaned. No peroxygen bleaches are disclosed.

GB 2166 153 discloses hard surface cleaning compositions comprising 1%–10% of a low boiling solvent (e.g. isopropanol), 1%–10% of propyleneglycol monobutyl ether, a nonfluorinated surfactant, a fluorinated surfactant, an alkaline material and water. Good greasy soil removal is achieved while leaving only an insubstantial amount of film on the surface cleaned. No peroxygen bleaches are disclosed.

SUMMARY OF THE INVENTION

The present invention encompasses a composition comprising a peroxygen bleach, an alcohol according to the formula R—OH wherein R is a linear or branched, saturated or unsaturated hydrocarbon chain of 1 to 4 carbon atoms, and a second solvent selected from the group consisting of a hydrophilic solvent comprising one or more ether groups and having a solubility in water higher than 10 ml per 100 ml at 25° C., a polyol hydrophilic solvent having a solubility in water higher than 10 ml per 100 ml at 25° C., a hydrophobic solvent having a solubility in water lower than 10 ml per 100 ml at 25° C. and mixtures thereof, at a weight ratio of said alcohol to said second solvent of 1:10 to 1:1.1.

The present invention further encompasses a method of cleaning a carpet wherein a composition as described herein before, is applied to said carpet, wherein said carpet is then optionally rubbed and/or brushed, and wherein said composition is then removed from said carpet.

All amounts, percentages and ratios are given by weight of the total composition in its neat form unless otherwise stated.

DETAILED DESCRIPTION OF THE INVENTION

The compositions:

The compositions according to the present invention may be formulated either as solids or liquids. In the case where the compositions are formulated as solids for example as granular compositions or powder compositions, they may be applied directly on the carpet to be treated or they may be diluted with an appropriate solvent, typically water, before use. In liquid form, the compositions are preferably but not necessarily formulated as aqueous compositions. Liquid compositions are preferred herein for convenience of use.

As a first essential ingredient, the compositions of the present invention comprise a peroxygen bleach or mixtures thereof.

A preferred peroxygen bleach according to the present invention is hydrogen peroxide or sources thereof. As used herein a hydrogen peroxide source refers to any compound which produces perhydroxyl ions when said compound is in contact with water. Indeed, the presence of a peroxygen bleach, preferably hydrogen peroxide contributes to the excellent cleaning and bleaching benefits of the compositions of the present invention.

Suitable water-soluble sources of hydrogen peroxide for use herein include percarbonates, persilicate, persulphate such as monopersulfate, perborates, preformed peroxyacids, alkyl hydroperoxides, peroxides, aliphatic diacyl peroxides and mixtures thereof. Hydrogen peroxide is preferred to be used in the compositions according to the present invention.

Suitable preformed peroxyacids for use in the compositions for the cleaning of carpets according to the present invention include diperoxydodecandioic acid DPDA, magnesium perphthalatic acid, perlauric acid, perbenzoic acid, diperoxyazelaic acid and mixtures thereof.

Suitable hydroperoxides for use herein are tert-butyl hydroperoxide, cumyl hydroperoxide, 2,4,4-trimethylpentyl-2-hydroperoxide, di-isopropylbenzene-monohydroperoxide, tert-amyl hydroperoxide, 2,5-dimethyl-hexane-2,5-dihydroperoxide or mixtures thereof.

Suitable aliphatic diacyl peroxides for use herein are dilauroyl peroxide, didecanoyl peroxide, dimyristoyl peroxide or mixtures thereof.

Typically, the compositions herein comprise from 0.01% to 20% by weight of the total composition of a peroxygen bleach, or mixtures thereof, preferably from 0.5% to 10%, and more preferably from 1% to 7%.

As a second essential ingredient, the compositions of the present invention comprise an alcohol of the formula R—OH wherein R is a linear or branched, saturated or unsaturated hydrocarbon chain of 1 to 4 carbon atoms, preferably of 2 to 4 carbon atoms and most preferably of 4 carbon atoms, or mxitures thereof.

Suitable alcohols to be used herein include isopropyl alcohol, propyl alcohol, ethanol and/or methanol. Highly preferred herein is isopropyl alcohol.

Isopropanol may be commercially available from Merck/BDH Italia under its chemical name.

As a third essential ingredient, the compositions of the present invention comprise a second solvent selected from the group consisting of hydrophilic solvents comprising one or more ether groups and having a solubility in water higher than 10 ml per 100 ml at 25° C., polyol hydrophilic solvents having a solubility in water higher than 10 ml per 100 ml at 25° C., hydrophobic solvents having a solubility in water lower than 10 ml per 100ml at 25° C. and mixtures thereof.

Preferably the hydrophilic solvents to be used herein have a solubility in water higher than 15 ml per 100 ml at 25° C. and more preferably higher than 20 ml per 100 ml at 25° C. The hydrophobic solvents to be used herein preferably have a solubility in water lower than 7 ml per 100 ml at 25° C. and more preferably lower than 5 ml per 100 ml at 25° C.

By "solubility" of a given compound it is to be understood herein the amount of said compound solubilized in deionized water at 25° C. Thus, a compound having a solubility being lower than 10 ml per 100ml means that when less than 10 ml of said given compound is incorporated in 100 ml of deionized water at 25° C. said compound is entirely dissolved in said water, i.e., a clear and stable solution is obtained. In other words, incorporating 10 ml per 100 ml or more of said given compound in water will result in a precipitation of said compound in said medium.

Suitable hydrophilic solvents comprising one or more ether groups to be used herein include glycol ethers and/or derivatives thereof. Suitable glycol ethers and/or derivatives thereof to be used herein include monoglycol ethers and/or derivatives thereof, polyglycol ethers and/or derivatives thereof and mixtures thereof.

Suitable monoglycol ethers and derivatives thereof to be used herein include n-buthoxypropanol (n-BP), water-soluble CELLOSOLVE® solvents or mixtures thereof. Preferred Cellosolve® solvents include propoxy ethyl acetate salt (i.e., Propyl Cellosolve acetate salt®), ethanol-2-butoxy phosphate salt (i.e., Butyl Cellosolve phosphate salt®), 2-(Hexyloxy)ethanol (i.e., 2-hexyl Cellosolve®), 2-ethoxy ethanol (i.e., 2-ethyl Cellosolve®), 2-butoxyethanol (i.e., 2-buthyl Cellosolve®) or mixtures thereof.

Suitable polyglycol ethers and derivatives thereof to be used herein include n-butoxypropoxypropanol (n-BPP), butyl triglycol ether (BTGE), butyl diglycol ether (BDGE), water-soluble CARBITOL® solvents or mixtures thereof.

Preferred water-soluble CARBITOL® solvents are compounds of the 2-(2-alkoxyethoxy)ethanol class, 2-(2-alkoxyethoxy)propanol class and/or 2-(2-alkoxyethoxy) butanol class wherein the alkoxy group is derived from ethyl, propyl or butyl. A preferred water-soluble carbitol is 2-(2-butoxyethoxy)ethanol also known as butyl carbitol®.

Preferred hydrophilic solvents having one or more ether groups for use herein are 2-ethoxyethanol, 2-butoxyethanol, n-butoxypropoxypropanol, butyl carbitol® or mixtures thereof.

Suitable polyol hydrophilic solvents to be used herein are the polyols having at least 2 hydroxyl groups (—OH) like diols. Suitable diols to be used herein include 2-ethyl-1,3-hexanediol, 2,2,4-trimethyl-1,3-pentanediol, methyl-2,4 pentanediol or mixture thereof.

Suitable hydrophobic solvents to be used herein include hydrophobic aliphatic or aromatic alcohols or mixtures thereof.

Suitable hydrophobic aromatic alcohols to be used herein are according to the formula $R_1$—OH wherein $R_1$ is an alkyl substituted or non-alkyl substituted aryl group of from 1 to 20 carbon atoms, preferably from 2 to 15 and more preferably from 2 to 10. A suitable aromatic alcohol to be used herein is benzyl alcohol.

Suitable hydrophobic aliphatic alcohols to be used herein are according to the formula $R_2$—OH wherein $R_2$ is a linear or branched saturated or unsaturated hydrocarbon chain of from 5 to 20 carbon atoms, preferably from 6 to 15 and more preferably from 8 to 10. Suitable aliphatic alcohols to be used herein include linear alcohols like 2-octanol and/or decanol.

The preferred hydrophobic solvent for use herein is benzyl alcohol.

It is essential herein that the C1–C4 alcohol and said second solvent as defined herein, are present in the compositions of the present invention at a weight ratio of said C1–C4 alcohol to said second solvent of 1:10 to 1:1.1, preferably of 1:6 to 1:1.5, more preferably of 1:4 to 1:1.8 and most preferably of 1:3 to 1:2. Also the total level of solvents present, i.e., C1–C4 alcohol and said second solvent, is from 0.5% to 20%, preferably from 1% to 10% and more preferably from 2% to 8% by weight of the total composition.

The compositions for the cleaning of carpets according to the present invention provide improved stain removal on various types of soils including diffuse soils (e.g., particulate and/or greasy soils) that tend to accumulate in the so called "high traffic areas" but also in delivering good cleaning performance on other types of stains or soils, i.e., on spot stains like bleachable stains (e.g., coffee, beverage, food) and/or enzymatic stains like blood.

By "improved stains removal performance" it is meant herein that the removal of particulate stains, greasy/oily stains, bleachable stains and/or enzymatic stains from carpets achieved by using a carpet cleaning composition comprising a peroxygen bleach, a C1–C4 alcohol and a second solvent, as defined herein, at particular weight ratio of said C1–C4 alcohol to said second solvent of 1:10 to 1:1.1, is improved, as compared to the stain removal obtained by using the same composition without such a solvent system or the same composition with only said C1–C4 alcohol or only said second solvent. More particularly, it has been unexpectedly found that a synergistic effect on particulate stains and/or greasy/oily stains and/or bleachable stains and/or enzymatic stains removal performance is associated to the use of a composition comprising a peroxygen bleach, a C1–C4 alcohol or mixtures thereof in combination with said second solvent, as defined herein, at a weight ratio of C1–C4 alcohol to said second solvent of 1:10 to 1:1.1.

By "particulate stains" it is meant herein any soils or stains of particulate nature that can be found on any carpet, e.g. clay, dirt, dust, mud, concrete and the like.

By "greasy/oily stains" it is meant herein any soils or stains of greasy/oily nature that can be found on any carpet, e.g., make-up, lipstick, dirty motor oil and mineral oil, greasy food like mayonnaise and spaghetti sauce.

By "bleachable stains" it is meant herein any soils or stains containing ingredients sensitive to bleach that can be found on any carpet, e.g., coffee or tea.

By "enzymatic stains" it is meant herein any soils or stains of enzymatic nature that can be found on any carpet, e.g., grass.

The stain removal performance of a given composition on a soiled carpet may be evaluated by the following test method. A liquid composition according to the present invention is first applied neat on the stained portion of a carpet, left to act thereon from about 1 to about 10 minutes, preferably 5 minutes, after which the carpet is rubbed with a sponge and vacuum cleaned after 24 hrs. Typical soils used in this test may be grass, dirty motor oil, tea, coffee, dust and/or mayonnaise.

The stain removal performance may be evaluated by comparing side by side the soiled carpet treated with the composition according to the present invention with those treated with the reference, e.g., the same composition without such a solvent system according to the present invention. A visual grading scale may be used to assign differences in panel score units (psu), in a range from 0 to 4.

It has surprising been find that the foam persistence is reduced with the compositions of the present invention, i.e., the liquid compositions of the present invention, or the granular or powder compositions herein that have been diluted typically with water so as to be applied onto the carpet to clean in a liquid form. It is speculated that such compositions comprising a peroxygen bleach and a solvent system as described herein, provide improved particulate soils by two different action mechanisms. Indeed, it is speculated that the different ingredients therein have a chemical action on particulate stains like dust, clay and the like as well as a mechanical action. Indeed, it is believed that when a composition according to the present invention, in its liquid form, is applied onto a carpet, the foam produced incorporates the particulate soils present in the carpet fibers and bring them to the surface of the carpet as it dissolves, facilitating thereby the particulate soil removal.

The foam persistence reduction can be evaluated by the following test method. A foam-meter instrument produced by SIRIS snc can be used to assess the foam profile. For example 500 gr. of a liquid composition to be tested is placed for analysis into a rotating cylinder at a speed of 40 rpm for 900 secondes. Then the foam height (e.g., in cm) generated at different times, e.g., 0, 1, 2, 3, 4, 5, 10, 15, 20 and 30 minutes can be recorded, as well as the rate of foam collapse (e.g., cm/min). Foam height and rate of foam collapse are indicative of foam persistence.

Also an advantage associated with the compositions herein comprising a peroxygen bleach, the solvent system as described herein, and being formulated as liquid aqueous compositions, is that said compositions deliver improved chemical stability as compared to the same compositions without said solvent system. Accordingly, said compositions are convenient for the consumer to use. Indeed, said liquid aqueous compositions for the cleaning of carpets according to the present invention do not require pH adjustment prior to use and can be stored for long periods of time prior to use.

The concentration of available oxygen can be determined by methods known in the art, such as the iodimetric method, the permanganometric method and the cerimetric method. Said methods and the criteria for the choice of the appropriate method are described for example in "Hydrogen Peroxide", W. C. Schumb, C. N. Satterfield and R. L. Wentworth, Reinhold Publishing Corporation, New York, 1955 and "Organic Peroxides", Daniel Swern, Editor Wiley Int. Science, 1970. A preferred method to be used herein is the iodimetric method.

As used herein, available oxygen concentration refers to the percentage concentration of elemental oxygen, with an oxidation number zero, that being reduced to water would be stoichiometrically equivalent to a given percentage concentration of a given peroxide compound, when the peroxide functionality of the peroxide compound is completely reduced to oxides. The peroxygen bleaches according to the present invention increase the ability of the compositions to remove colored stains, to destroy malodorous molecules and to kill germs.

The pH of the liquid compositions according to the present invention can be from 1 to 14. In a preferred embodiment, the recommended pH range is from 1 to 8, preferably between pH 1 and 7, more preferably between pH 1 and 6 and most preferably between 4 and 6. Indeed, it has been surprisingly found that stain removal performance is further improved at these preferred pH ranges. Also these preferred pH ranges contribute to the stability of hydrogen peroxide. Accordingly, the compositions herein may further comprise an acid or base to adjust pH as appropriate. The acids that may be used for these purposes can be organic or inorganic acids, preferably inorganic acids such as sulphuric acid. The bases to be used herein can be organic or inorganic bases, preferably inorganic bases such as sodium hydroxide.

Optional ingredients:

The compositions herein may further comprise a number of additional compounds such as surfactants, soil suspending polyamine polymers, soil suspending polycarboxylate polymers, chelating agents, builder system, other solvents, perfumes, dyes, suds suppressing agents, enzymes, photobleaching agents, and other minors.

Surfactants may be used in the compositions of the present invention. Surfactants for use herein are those well known in the art and include anionic, nonionic, zwitterionic, amphoteric and cationic surfactants and mixtures thereof. The surfactants suitable for use herein are compatible with peroxygen bleaches like hydrogen peroxide and sources thereof. Typically, the compositions herein comprise up to 50% by weight of the total composition of a surfactant or mixtures thereof, preferably from 0.1% to 30% and more preferably from 0.5% to 10%.

Particularly suitable surfactants to be used herein are anionic surfactants. Said anionic surfactants are preferred herein as they further contribute to the outstanding stain removal performance of the compositions of the present invention on various type of stains. Moreover they do not stick on carpet, thereby reducing resoiling.

Suitable anionic surfactants for use herein include sulfonate and sulfate surfactants. The like anionic surfactants are well-known in the art and have found wide application in commercial detergents. These anionic surfactants include the C8–C22 alkyl benzene sulfonates (LAS), the C8–C22 alkyl sulfates (AS), unsaturated sulfates such as oleyl sulfate, the C10–C18 alkyl alkoxy sulfates (AES) and the C10–C18 alkyl alkoxy carboxylates. The neutralising cation for the anionic synthetic sulfonates and/or sulfates is represented by conventional cations which are widely used in detergent technology such as sodium, potassium or alkanolammonium. Preferred herein are the alkyl sulphate, especially coconut alkyl sulphate having from 6 to 18 carbon atoms in the alkyl chain, preferably from 8 to 15, or mixtures thereof.

Other anionic surfactants useful for detersive purposes can also be used herein. These can include salts (including, for example, sodium, potassium, ammonium, and substituted ammonium salts such as mono-, di- and triethanolamine salts) of soap, $C_8$–$C_{22}$ primary or secondary alkanesulfonates, $C_8$–$C_{24}$ olefinsulfonates, sulfonated polycarboxylic acids prepared by sulfonation of the pyrolyzed product of alkaline earth metal citrates, e.g., as described in British patent specification No. 1,082,179, $C_8$–$C_{24}$ alkylpolyglycolethersulfates (containing up to 10 moles of ethylene oxide); alkyl ester sulfonates such as $C_1$4-16 methyl ester sulfonates; acyl glycerol sulfonates, fatty oleyl glycerol sulfates, alkyl phenol ethylene oxide ether sulfates, paraffin sulfonates, alkyl phosphates, isethionates such as the acyl isethionates, N-acyl taurates, alkyl succinamates and sulfosuccinates, monoesters of sulfosuccinate (especially saturated and unsaturated $C_{12}$–$C_{18}$ monoesters) diesters of sulfosuccinate (especially saturated and unsaturated $C_6$–C14 diesters), sulfates of alkylpolysaccharides such as the sulfates of alkylpolyglucoside (the nonioric nonsulfated compounds being described below). Resin acids and hydrogenated resin acids are also suitable, such as rosin, hydrogenated rosin, and resin acids and hydrogenated resin acids present in or derived from tall oil. Further examples are given in "Surface Active Agents arid Detergents" (Vol. I and II by Schwartz, Perry and Berch). A variety of such surfactants are also generally disclosed in U.S. Pat. No.

3,929,678, issued Dec. 30, 1975 to Laughlin, et al. at Column 23, line 58 through Column 29, line 23 (herein incorporated by reference).

Other suitable anionic surfactants to be used herein also include acyl sarcosinate or mixtures thereof, in its acid and/or salt form, preferably long chain acyl sarcosinates having the following formula:

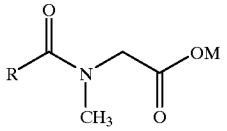

wherein M is hydrogen or a cationic moiety and wherein R is an alkyl group of from 11 to 15 carbon atoms, preferably of from 11 to 13 carbon atoms. Preferred M are hydrogen and alkali metal salts, especially sodium and potassium. Said acyl sarcosinate surfactants are derived from natural fatty acids and the amino-acid sarcosine (N-methyl glycine). They are suitable to be used as aqueous solution of their salt or in their acidic form as powder. Being derivatives of natural fatty acids, said acyl sarcosinates are rapidly and completely biodegradable and have good skin compatibility.

Accordingly, particularly preferred long chain acyl sarcosinates to be used herein include $C_{12}$ acyl sarcosinate (i.e. an acyl sarcosinate according to the above formula wherein M is hydrogen and R is an alkyl group of 11 carbon atoms) and $C_{14}$ acyl sarcosinate (i.e. an acyl sarcosinate according to the above formula wherein M is hydrogen and R is an alkyl group of 13 carbon atoms). $C_{12}$ acyl sarcosinate is commercially available, for example, as Hamposyl L-30® supplied by Hampshire. $C_{14}$ acyl sarcosinate is commercially available, for example, as Hamposyl M-30® supplied by Hampshire.

Other particularly suitable surfactants to be used herein include amine oxide surfactants according to the formula R1R2R3NO, wherein each of R1, R2 and R3 is independently a saturated substituted or unsubstituted, linear or branched alkyl groups of from 1 to 30 carbon atoms, preferably of from 1 to 20 carbon atoms, and mixtures thereof.

Particularly preferred amine oxide surfactants to be used according to the present invention are amine oxide surfactants having the following formula $R_1R_2R_3NO$ wherein R1 is a saturated linear or branched alkyl group of from 1 to 30 carbon atoms, preferably of from 6 to 20 carbon atoms, more preferably of from 6 to 16 carbon atoms, and wherein R2 and R3 are independently substituted or unsubstituted, linear or branched alkyl groups of from 1 to 4 carbon atoms, preferably of from 1 to 3 carbon atoms, and more preferably are methyl groups. In the most preferred embodiment of the present invention said amine oxide surfactants used herein are pure-cut amine oxide surfactants, i.e., a pure single amine oxide surfactant, e.g. $C_8$ N,N-dimethyl amine oxide, as opposed to mixtures of amine oxide surfactants of different chain lengths.

Suitable amine oxide surfactants for use herein are for instance pure cut C8 amine oxide, pure cut C10 amine oxide, pure cut C14 amine oxide, natural blend C8–C10 amine oxides as well as natural blend C12–C16 amine oxides. Such amine oxide surfactants may be commercially available from Hoechst or Stephan.

Said amine oxide surfactants are preferred herein as they further contribute to the outstanding stain removal performance of the compositions herein on various type of stains. Also said amine oxide surfactants contribute to improve the chemical stability of said compositions. It is believed that improved chemical stability associated to the use of said amine oxide surfactants in bleaching compositions is due to the capacity of said amine oxide surfactants to lower the decomposition of said source of active oxygen and/or to limit interactions between said source of active oxygen and a bleach activator, if present, possibly through emulsification. It is believed that this stabilising effect is matrix independent.

Furthermore, amine oxide surfactants, especially pure-cut amine oxide surfactants, have the advantage to reduce the amount of residues left onto carpet fibers being treated with a composition comprising them. Also, tie residues left after said composition comprising them has performed its cleaning action onto said carpet fibers are partially in a crystalline form. Indeed, it has been observed that with the compositions of the present invention which comprise said amine oxide surfactants, and especially a pure-cut amine oxide surfactant, more than 90%, preferably more than 95% of the residues left onto the carpet fibers are crystals (generally lamellar and/or needle-shaped) with an average particle surface bigger than 300 $\mu^2$. This results in a process of cleaning carpets whereby the residues left onto the carpets are removed more easily as opposed to residues being sticky and thus difficult to remove by for example vacuum cleaning said carpets.

The nonionic surfactants which may be used herein include any liquid or solid ethoxylated $C_6$–$C_{24}$ fatty alcohol nonionic surfactant, alkyl propoxylates and mixtures thereof, fatty acid $C_6$–$C_{24}$ alkanolamides, $C_6$–$C_{20}$ polyethylglycol ethers, polyethylene glycol with molecular weight 1000 to 80000 and glucose amides, alkyl pyrrolidones, betaines.

Suitable cationic surfactants for use herein include quaternary ammonium compounds of the formula $R_1R_2R_3R_4N+$ where $R_1$,$R_2$ and $R_3$ are methyl groups, and $R_4$ is a $C_{12-15}$ alkyl group, or where $R_1$ is an ethyl or hydroxy ethyl group, $R_2$ and $R_3$ are methyl groups and $R_4$ is a $C_{12-15}$ alkyl group.

Zwitterionic surfactants are also suitable optional ingredients for use herein. Suitable zwitterionic surfactants include derivatives of aliphatic quaternary ammonium, phosphonium, and sulphonium compounds in which the aliphatic moiety can be straight or branched chain and wherein one of the aliphatic substituents contains from about 8 to about 24 carbon atoms and another substituent contains, at least, an anionic water-solubilizing group. Particularly preferred zwitterionic materials are the ethoxylated ammonium sulphonates and sulfates disclosed in U.S. Pat. No. 3,925,262, Laughlin et al., issued Dec. 9, 1975 and U.S. Pat. No. 3,929,678, Laughlin et al., issued Dec. 30, 1975.

Any soil suspending polycarboxylate polymer known to those skilled in the art can be use according to the present invention such as homo- or copolymeric polycarboxylic acids or their salts including polyacrylates and copolymers of maleic anhydride or/and acrylic acid and the like. Indeed, such soil suspending polycarboxylate polymers can be prepared by polymerizing or copolymerizing suitable unsaturated monomers, preferably in their acid form. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and methylenemalonic acid. The presence in the polymeric polycarboxylates herein of monomeric segments, containing no carboxylate radicals such as vinylmethyl ether, styrene, ethylene, etc. is suitable provided that such segments do not constitute more than about 40% by weight.

Particularly suitable polymeric polycarboxylates to be used herein can be derived from acrylic acid. Such acrylic acid-based polymers which are useful herein are the water-soluble salts of polymerized acrylic acid. The average molecular weight of such polymers in the acid form preferably ranges from about 2,000 to 10,000, more preferably from about 4,000 to 7,000 and most preferably from about 4,000 to 5,000. Water-soluble salts of such acrylic acid polymers can include, for example, the alkali metal, ammonium and substituted ammonium salts. Soluble polymers of this type are known materials. Use of polyacrylates of this type in detergent compositions has been disclosed, for example, in Diehl, U.S. Pat. No. 3,308,067, issued Mar. 7, 1967.

Acrylic/maleic-based copolymers may also be used as a preferred soil suspending polycarboxylic polymer. Such materials include the water-soluble salts of copolymers of acrylic acid and maleic acid. The average molecular weight of such copolymers in the acid form preferably ranges from about 2,000 to 100,000, more preferably from about 5,000 to 75,000, most preferably from about 7,000 to 65,000. The ratio of acrylate to maleate segments in such copolymers will generally range from about 30:1 to about 1:1, more preferably from about 10:1 to 2:1. Water-soluble salts of such acrylic acid/maleic acid copolymers can include, for example, the alkali metal, ammonium and substituted ammonium salts. Soluble acrylate/maleate copolymers of this type are known materials which are described in European Patent Application No. 66915, published Dec. 15, 1982. Particularly preferred is a copolymer of maleic/acrylic acid with an average molecular weight of about 70,000. Such copolymers are commercially available from BASF under the trade name SOKALAN CP5.

Typically, the compositions herein comprise up to 10% by weight of the total composition of a soil suspending polycarboxylate polymer or mixtures thereof, preferably from 0.1% to 8% and more preferably from 0.5% to 4%.

Any soil suspending polyamine polymer known to those skilled in the art may also be used herein. Particularly suitable polyamine polymers for use herein are polymers having polyalkoxymoiety are alkoxylated polyamines. Such materials can conveniently be represented as molecules of the empirical structures with repeating units:

Amine form

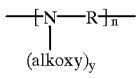

and

Quaternized form

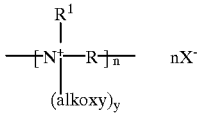

wherein R is a hydrocarbyl group, usually of 2–6 carbon atoms; $R^1$ may be a $C_1$–$C_{20}$ hydrocarbon; the alkoxy groups are ethoxy, propoxy, and the like, and y is 2–30, most preferably from 10–20; n is an integer of at least 2, preferably from 2–20, most preferably 3–5; and $X^-$ is an anion such as halide or methylsulfate, resulting from the quaternization reaction.

The most highly preferred polyamines for use herein are the so-called ethoxylated polyethylene amines, i.e., the polymerized reaction product of ethylene oxide with ethyleneimine, having the general formula

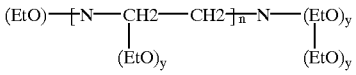

when y=2–30. Particularly preferred for use herein is an ethoxylated polyethylene amine, in particular ethoxylated tetraethylenepentamine, and quaternized ethoxylated hexamethylene diamine.

Typically, the compositions herein comprise up to 10% by weight of the total composition of a soil suspending polyamine polymer or mixtures thereof, preferably from 0.1% to 8% and more preferably from 0.5% to 4%.

The compositions herein may also comprise a hydroxy pyridine N-oxides; or derivatives thereof according to the following formula:

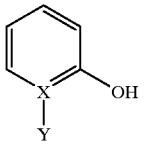

wherein X is nitrogen, Y is one of the following groups oxygen, —CHO, —OH, —(CH2)n—COOH, wherein n is an integer of from 0 to 20, preferably of from 0 to 10 and more preferably is 0, and wherein Y is preferably oxygen. Accordingly particularly preferred hydroxy pyridine N-oxides or derivatives thereof to be used herein is 2-hydroxy pyridine N-oxide.

Hydroxy pyridine N-oxides or derivatives thereof may be commercially available from Sigma.

Typically, the compositions herein comprise up to 2% by weight of the total composition of a hydroxy pyridine N-oxide or derivatives thereof or mixtures thereof, preferably from 0.001% to 1% and more preferably from 0.001% to 0.5%.

The compositions herein may also comprise a chelating agent or mixtures thereof. Suitable chelating agents are those known to those skilled in the art. Suitable chelating agents include for examples phosphonate chelating agents, polyfunctionally-substituted aromatic chelating agents, amino carboxylate chelating agents, other chelating agents like ethylene diamine N,N'-disuccinic acid and mixtures thereof. Typically, the compositions herein comprise up to 4% by weight of the total composition of a chelating agent or mixtures thereof, preferably from 0.001% to 1%, and more preferably from 0.001% to 0.5%.

Suitable phosphonate chelating agents to be used herein may include ethydronic acid, alkali metal ethane 1-hydroxy diphosphonates as well as amino phosphonate compounds, including amino alkylene poly (alkylene phosphonate), alkali metal ethane 1-hydroxy diphosphonates, nitrilo trimethylene phosphonates, ethylene diamine tetra methylene phosphonates, and diethylene triamine penta methylene phosphonates. The phosphonate compounds may be present either in their acid form or as salts of different cations on some or all of their acid functionalities. Preferred phosphonate chelating agents to be used herein are diethylene triamine penta methylene phosphonates (DETPMP). Such phosphonate chelating agents are commercially available from Monsanto under the trade name DEQUEST®.

Polyfunctionally-substituted aromatic chelating agents may also be useful in the compositions herein. See U.S. Pat.

No. 3,812,044, issued May 21, 1974, to Connor et al. Preferred compounds of this type in acid form are dihydroxydisulfobenzenes such as 1,2-dihydroxy -3,5-disulfobenzene.

A preferred biodegradable chelating agent for use herein is ethylene diamine N,N'-disuccinic acid, or alkali metal, or alkaline earth, ammonium or substitutes ammonium salts thereof or mixtures thereof. Ethylenediamine N,N'-disuccinic acids, especially the (S,S) isomer have been extensively described in U.S. Pat. No. 4,704,233, Nov. 3, 1987. to Hartman and Perkins. Ethylenediamine N,N'-disuccinic acids is, for instance, commercially available under the tradename ssEDDS® from Palmer Research Laboratories.

Suitable amino carboxylate chelating agents to be used herein include ethylene diamine tetra acetates, diethylene triamine pentaacetates, diethylene triamine pentaacetate (DTPA), N-hydroxyethylethylenediamine triacetates, nitrilotri-acetates, ethylenediamine tetrapropionates, triethylenetetraaminehexa-acetates, ethanoldiglycines, propylene diamine tetracetic acid (PDTA) and methyl glycine di-acetic acid (MGDA), both in their acid form, or in their alkali metal, ammonium, and substituted ammonium salt forms. Particularly suitable amino carboxylates to be used herein is diethylene triamine penta acetic acid (DTPA).

Other suitable chelating agents to be used herein include salicylic acid or derivatives thereof, or mixtures thereof according to the following formula:

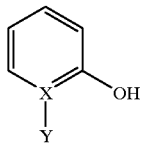

wherein X is carbon, Y is one of the following groups —CHO, —OH, —(CH2)n—COOH, and preferably is —(CH2)n—COOH, and wherein n is an integer of from 0 to 20, preferably of from 0 to 10 and more preferably is 0. Salicylic acid and derivatives thereof may be used herein either in their acid form or in their salts form as for example sodium salts.

Salicylic acid is particularly preferred herein and may be commercially available from Rhone Poulenc.

The compositions according to the present invention may further comprise propyl gallate up to a level of 1% by weight of the total composition, preferably from 0.01% to 0.1%, and more preferably from 0.01% to 0.06%. It has now been found that the addition of propyl gallate in the liquid peroxygen bleach-containing compositions of the present invention comprising a C1–C4 alcohol and said second solvent, as defined herein, further contributes to deliver excellent chemical stability to said compositions.

The compositions according to the present invention may further comprise a bleach activator or mixtures thereof, as another optional ingredient. By "bleach activator", it is meant herein a compound which reacts with hydrogen peroxide to form a peracid. The peracid thus formed constitutes the activated bleach. Suitable bleach activators to be used herein include those belonging to the class of esters, amides, imides, or anhydrides. Examples of suitable compounds of this type are disclosed in British Patent GB 1 586 769 and GB 2 143 231 and a method for their formation into a prilled form is described in European Published Patent Application EP-A-62 523. Suitable examples of such compounds to be used herein are tetracetyl ethylene diamine (TAED), sodium 3,5,5 trimethyl hexanoyloxybenzene sulphonate, diperoxy dodecanoic acid as described for instance in U.S. Pat. No. 4,818,425 and nonylamide of peroxyadipic acid as described for instance in U.S. Pat. No. 4,259,201 and n-nonanoyloxybenzenesulphonate (NOBS). Also suitable are N-acyl caprolactam selected from the group consisting of substituted or unsubstituted benzoyl caprolactam, octanoyl caprolactam, nonanoyl caprolactam, hexanoyl caprolactam, decanoyl caprolactam, undecenoyl caprolactam, formyl caprolactam, acetyl caprolactam, propanoyl caprolactam, butanoyl caprolactam pentanoyl caprolactam or mixtures thereof. A particular family of bleach activators of interest was disclosed in EP 624 1 54, and particularly preferred in that family is acetyl triethyl citrate (ATC). Acetyl triethyl citrate has the advantage that it is environmentally friendly as it eventually degrades into citric acid and alcohol. Furthermore, acetyl triethyl citrate has a good hydrolytical stability in the composition upon storage and it is an efficient bleach activator.

The compositions according to the present invention may comprise up to 30% by weight of the total composition of said bleach activator, or mixtures thereof, preferably from 1% to 20%, and more preferably from 2% to 10%.

The compositions according to the present invention may further comprise a builder system. Any conventional builder system known in the art is suitable for use herein. Suitable builders for use herein include derivatives of succinic acid of the formula R_CH(COOH)$CH_2$(COOH) wherein R is $C_{10-20}$ alkyl or alkenyl, preferably $C_{12-16}$, or wherein R can be substituted with hydroxyl, sulpho sulphoxyl or sulphone substituents. Specific examples include lauryl succinate, myristyl succinate, palmityl succinate, 2-dodecenylsuccinate, 2-tetradecenyl succinate. Succinate builders are preferably used in the form of their water-soluble salts, including sodium, potassium, ammonium and alkanolammonium salts.

Other suitable builders are oxodisuccinates and mixtures of tartrate monosuccinic and tartrate disuccinic acid such as described in U.S. Pat. No. 4,663,071.

Further suitable builders for use herein are fatty acid builders including saturated or unsaturated $C_{10-18}$ fatty acids, as well as the corresponding soaps. Preferred saturated species have from 12 to 16 carbon atoms in the alkyl chain. The preferred unsaturated fatty acid is oleic acid.

The compositions herein may comprise from 0% to 10%, preferably from 1% to 7% by weight of the total composition of a builder system.

Method of cleaning a carpet

The present invention also encompasses a method of cleaning a carpet wherein a composition as described herein, is applied to said carpet, wherein said carpet is then optionally rubbed and/or brushed, and wherein said composition is then removed from said carpet.

Indeed, in the method of cleaning a carpet according to the present invention the step of applying a composition for the cleaning of carpets as described herein before, may be followed by a rubbing step and/or a brushing step. An advantage of the present invention is that the cleaning action of the present compositions commence as soon as said compositions are applied onto said carpet. Thus the cleaning process of the present invention does not necessarily require rubbing and/or brushing. It is only in the case of highly soiled carpets or in the so called "high traffic areas" that the carpet may be cleaned by applying onto it a composition for the cleaning of carpets according to the present invention, then rubbing and/or brushing it more or less intensively for example by means of a sponge or a brush or other mechanical/electrical device, optionally with the aid of water. In general the rubbing/brushing-times are between 0.1 to a few minutes per square meters. After the composition for the cleaning of carpets according to the present invention has been applied onto the carpet and optionally rubbed and/or brushed, that said composition is removed from said carpet, preferably by mechanical means including brushing out and/or vacuum cleaning.

The compositions for the cleaning of carpets according to the present invention may be applied to the carpet to be cleaned either in neat or diluted form, this applies to compositions being either liquid compositions or granular compositions or powder compositions.

By "diluted form" it is meant herein that the compositions for the cleaning of carpets as described herein before may be diluted by the user, preferably with water. Compositions herein can be diluted up to 150 times, preferably up to 50 times and more preferably up to 25 times.

In a preferred embodiment herein, the compositions for the cleaning of carpets according to the present invention are liquid aqueous compositions. Indeed, a liquid aqueous composition, i.e., an aqueous composition for the cleaning of carpets as described herein before in its neat form or which has been diluted with water by the user or an aqueous composition resulting from the dilution of a granular composition or of a powder composition, is applied to the carpet to be cleaned, said carpet is optionally rubbed and/or brushed, then said composition is left to dry and then removed from said carpet. Indeed, said liquid aqueous composition is left to dry until said composition which combined with dirt has been changed into dry residues. These residues are then removed from the carpet mechanically. Such liquid aqueous compositions may be applied directly onto the area to be treated or applied using a cloth or piece of material such as spraying device or aerosol can, a sponge, a brush or other mechanical/electrical device. In a preferred embodiment of the invention a liquid aqueous composition is applied to the area to be treated by using a spraying device or an aerosol can. Such a spraying device may be trigger operated or pump operated or electrically operated or operated by any source of pressurised gas such as a can or a pressurizer. Such spraying devices are particularly preferable if a large area is to be treated as it facilitates the ease of use for the consumer. The spraying devices ensure uniform coverage of the area to be treated and maximises the advantage of the using liquid aqueous compositions containing peroxides. This is because the application of product by spray best allows the product to be left to dry on the area treated, even without rubbing or brushing. This optimises the action time of the composition and allows the best exploitation of the bleaching action of peroxides.

In another embodiment, the compositions for the cleaning of carpets according to the present invention are granular compositions or powder compositions. Such compositions for the cleaning of carpets according to the present invention may be applied directly onto the area of the carpet to be treated by for example sprinkling said composition over said area or may be applied by using a sponge, a brush, or other mechanical/electrical device preferably in presence of water and then left to dry and then removed from said carpet.

The area to be treated using the compositions according to the present invention may be any size. In addition a complete section or even a whole carpet may be applied with the composition for the cleaning of carpets according to the present invention. For such purposes when using a liquid aqueous composition a spraying device with a pump to allow prolonged spraying is particularly useful.

The amount of the compositions for the cleaning of carpets according to the present invention applied will depend on the severity of the stain or soil. In the case of stubborn stains more than one application may be required to ensure complete removal of the stain. Indeed, the carpet cleaning compositions herein are particularly suitable to remove the dinginess of the carpets resulting from a diffused layer of soil which results from general wear.

The compositions for the cleaning of carpets according to the present invention may be used both for manual carpet cleaning and carpet cleaning machines. For carpet cleaning machines the compositions for the cleaning of carpets according to the present invention, i.e., either liquid compositions or granular compositions or powder compositions, may be preferably diluted according to the machine operating instructions. Furthermore, compositions to be used in such machines are formulated to prevent high sudsing.

According to the present invention the compositions herein may be used for the removal of stains and soils from carpets or upholstery as well as of odors. In addition the compositions according to the present invention may be used to hygienise or disinfect carpets and exterminate micro-insects from the carpet or upholstery.

EXAMPLES

The following examples will illustrate the present invention. The compositions are made by combining the listed ingredients in the listed proportions (weight % unless otherwise specified).

| Compositions (weight %) | I | II | III | IV | V |
|---|---|---|---|---|---|
| Hydrogen peroxide | 5.0 | 6.0 | 6.0 | 3.0 | 4.0 |
| Na CnAS | 3.0 | — | 1.0 | 3.0 | 3.0 |
| PA | 1.0 | 0.5 | 0.2 | 1.5 | — |
| AMCP | — | 1.0 | 2.0 | — | 2.0 |
| C8 amine oxide | — | 1.0 | 2.0 | — | 2.0 |
| C14 amine oxide | — | 1.0 | 1.0 | — | — |
| C10 amine oxide | — | 1.0 | — | — | — |
| Salicylic Acid | 0.1 | 0.01 | — | 0.03 | — |
| Chelant* | 0.1 | 0.01 | — | 0.03 | — |
| Benzyl alcohol | — | 1.0 | 3.0 | — | — |
| Isopropylalcohol | 1.0 | 1.0 | 1.0 | 1.0 | 1.0 |
| Ethoxyl ethanol | 2.0 | — | — | — | — |
| Butoxy ethanol | — | 1.0 | — | 2.0 | 2.0 |
| Propyl Gallate | 0.01 | 0.03 | 0.1 | — | — |
| Water | Balance | Balance | Balance | Balance | Balance |
| up to pH | 5 | 4 | 5 | 6 | 5 |

| Compositions (weight %) | VI | VII | VIII | IX | X | XI |
|---|---|---|---|---|---|---|
| Hydrogen peroxide | 7.0 | 7.0 | 7.0 | 4.0 | 7.0 | 1.0 |
| Na CnAS | 1.0 | | 3.0 | 3.0 | 2.0 | 3.0 |
| PA | 0.8 | — | 1.0 | — | — | 0.9 |
| AMCP | — | — | — | 1.0 | 2.0 | 1.0 |
| C8 amine oxide | — | — | — | — | — | — |
| C14 amine oxide | — | — | — | — | — | — |
| C10 amine oxide | — | — | — | — | — | — |
| Salicylic Acid | 0.03 | — | — | — | — | 0.03 |
| Chelant* | 0.03 | — | — | 0.5 | — | — |
| Benzyl alcohol | 3.0 | 4.0 | 5.0 | 3.0 | 1.0 | 3.0 |
| Isopropylalcohol | 0.5 | 1.5 | 1.0 | 2.0 | 1.0 | 1.0 |
| Ethoxyl ethanol | — | — | — | — | 2.0 | — |
| Butoxy ethanol | — | — | — | — | — | 1.0 |
| Propyl Gallate | 0.01 | — | — | — | — | 0.02 |
| Water | Balance | Balance | Balance | Balance | Balance | Balance |
| up to pH | 4 | 6 | 6 | 7 | 6 | 0 |

AMCP is acrylic/malic based copolymers (Sokalan CP5®)

Chelant used is a phosphonate chelant available under the trade name DEQUEST®.

Na CnAS is sodium alkyl sulphate.

PA is an ethoxylated tetraethylenepentamine, average molecular weight about 70,000.

The compositions in the examples above are suitable for the cleaning of carpets according to the present invention, i.e., they exhibit excellent particulate soil, greasy/oily soil, and/or enzymatic soil removing performance while providing also excellent stain removal performance on other types of soils such as bleachable stains like coffee, tea and the like.

These compositions are suitable to be used in manual carpet cleaning applications, neat or diluted, as well as in carpet cleaning machines.

These compositions are also chemically stable upon prolonged storage periods. Indeed, no bottle bulging was observed with the compositions exemplified above when stored in polyethylene-based plastic 500 ml bottles for 10 days at 50° C.

What is claimed is:

1. A composition suitable for cleaning carpet comprising:

(a) a peroxygen bleach;

(b) an alcohol having the formula R—OH wherein R is a linear or branched, saturated or unsaturated hydrocarbon chain of 1 to 4 carbon atoms; and (c) a second solvent selected from the group consisting of:

(i) a hydrophilic solvent comprising one or more ether groups and having a solubility in water higher than 10 ml per 100 ml at 25° C.; wherein said hydrophilic solvent is selected from the group consisting of butoxypropanol, propoxy ethyl acetate, ethanol-2-butoxy phosphate, 2-(hexyloxy)ethanol, 2-ethoxy ethanol, 2-butoxyethanol, n-butoxypropanol, butyl triglycol ether, butyl diglycol ether, 2-(2-alkoxyethoxy)ethanol, 2-(2-alkoxyethoxy)propanol, 2-(2-alkoxyethoxy)butanol, and mixtures thereof;

(ii) a polyol hydrophilic solvent having a solubility in water higher than 10 ml per 100 ml at 25° C.; wherein said polyol hydrophilic solvent is selected from the group consisting of 2-ethyl-1,3-hexanediol, 2,2,4-trimethyl-1,3-pentanediol, methyl-2,4 pentanediol, and mixture thereof;

(iii) a hydrophobic solvent having a solubility in water lower than 10 ml per 100 ml at 25° C.; wherein said hydrophobic solvent is benzyl alcohol; and (iv) mixtures thereof, wherein said composition has a weight ratio of said alcohol to said second solvent of 1:10 to 1:1.1 and has a pH of from 1 to 6.

2. A composition according to claim 1 wherein said C1–C4 alcohol is isopropyl alcohol.

3. A composition according to claim 1 wherein said C1–C4 alcohol and said second solvent are present at a weight ratio of said C1–C4 alcohol to said second solvent of about 1:6 to about 1:1.5.

4. A composition according to claim 3 wherein said C1–C4 alcohol and said second solvent are present at a weight ratio of said C1–C4 alcohol to said second solvent of about 1:4 to about 1:1.8.

5. A composition according to claim 4 wherein said C1–C4 alcohol and said second solvent are present at a weight ratio of said C1–C4 alcohol to said second solvent of about 1:3 to about 1:2.

6. A composition according to claim 1 wherein said peroxygen bleach is selected from the group consisting of percarbonate, persilicate, persulphate, perborate, preformed peroxyacid, alkyl hydroperoxide, peroxide, aliphatic diacyl peroxide and mixtures thereof.

7. A composition according to claim 6 wherein said peroxygen bleach is hydrogen peroxide.

8. A composition according to claim 1 which comprises from about 0.01% to about 20% by weight of the total composition of peroxygen bleach or mixtures thereof.

9. A composition according to claim 8 which comprises from about 0.5% to about 10% by weight of the total composition of peroxygen bleach or mixtures thereof.

10. A composition according to claim 9 which comprises from about 1% to about 7% by weight of the total composition of peroxygen bleach or mixtures thereof.

11. A composition according to claim 1 which comprises up to about 50% by weight of the total composition of a surfactant selected from the group consisting of anionic surfactant, amphoteric sufactant, nonionic surfactant, zwitterionic surfactant, cationic surfactant and mixtures thereof.

12. A composition according to claim 11 which comprises from about 0.1% to about 30% by weight of the total composition of said surfactant or mixtures thereof.

13. A composition according to claim 12 which comprises from about 0.5% to about 10% by weight of the total composition of said surfactant or mixtures thereof.

14. A composition according to claim 11 wherein said surfactant is an anionic surfactant, preferably a sarcosinate surfactant and/or an alkyl sulphate surfactant, and/or an amine oxide surfactant according to the formula $R_1R_2R_3NO$ wherein R1 is a saturated linear or branched alkyl group of from about 1 to about 30 carbon atoms, wherein R2 and R3 are independently substituted or unsubstituted, linear or branched alkyl groups of from about 1 to about 4 carbon atoms, or mixtures thereof.

15. A composition according to claim 1 which further comprises propyl gallate up to a level of about 1% by weight of the total composition.

16. A composition according to claim 15 which comprises propyl gallate at a level of from about 0.01% to about 0.1% by weight of the total composition.

17. A composition according to claim 16 which comprises propyl gallate at a level of from about 0.01% to about 0.06% by weight of the total composition.

18. A composition according to claim 1 which further comprises at least one ingredient selected from the group consisting of soil suspending polyamine polymer, soil suspending polycarboxylate polymer, chelating agent, hydroxypyridine N-oxides and derivatives thereof, builder systems, other solvents, perfumes, dyes, suds suppressing agents, enzymes, photobleaching agents, and mixtures thereof.

19. A composition according to claim 18 which is a liquid composition.

20. A composition according to claim 18, wherein said composition is a powder composition or a granular composition.

21. A method of cleaning a carpet wherein a composition according to claim 20, is applied to said carpet, wherein said carpet is then optionally rubbed and/or brushed, and wherein said composition is then removed from said carpet.

22. A method of cleaning carpet wherein a composition according to claim 19 is applied neat or diluted to said carpet, or wherein a composition according to claim 5 is diluted typically with water before being applied to said carpet, said carpet is then optionally rubbed and/or brushed, and said composition is left to dry before being removed from said carpet.

23. A method according to claim 22 wherein said composition is used in carpet cleaning machines.

24. A method according to claim 22 wherein said composition is applied to said carpet by means of a spraying device or an aerosol can.

25. A method according to claim 21 wherein said composition is removed from said carpet by mechanical means including brushing out and/or vacuum cleaning.

26. A method according to claim 22 wherein said composition is removed from said carpet by mechanical means including brushing out and/or vacuum cleaning.

27. A composition according to claim 19 which is an aqueous liquid composition.

* * * * *